United States Patent [19]

Burns et al.

[11] 4,417,904

[45] Nov. 29, 1983

[54] N,N'-DIALKYL-N,N'-DIPHENYL ALKYLENE DIAMINE DERIVATIVES AS ANTIKNOCK AGENTS

[75] Inventors: Lyle D. Burns; Robert M. Parlman, both of Bartlesville, Okla.

[73] Assignee: Phillips Petroleum Company, Bartlesville, Okla.

[21] Appl. No.: 331,422

[22] Filed: Dec. 16, 1981

[51] Int. Cl.[3] ..... C10L 1/22

[52] U.S. Cl. ..... 44/72; 252/386

[58] Field of Search ..... 252/386; 44/72; 564/305, 306

[56] References Cited

U.S. PATENT DOCUMENTS

| | | | |
|---|---|---|---|
| 3,523,769 | 8/1970 | Tooke | 44/72 |
| 3,705,024 | 12/1972 | Zimmerman et al. | 44/72 |
| 3,706,541 | 12/1972 | Stournas et al. | 44/63 |
| 4,284,815 | 8/1981 | Marquis et al. | 564/332 |
| 4,284,816 | 8/1981 | Marquis et al. | 564/332 |
| 4,287,364 | 9/1981 | Marquis et al. | 564/332 |

*Primary Examiner*—Charles F. Warren
*Assistant Examiner*—Y. Harris-Smith

[57] ABSTRACT

The antiknock properties of fuel compositions are improved by adding thereto one or more compounds of the general formula

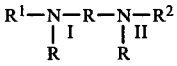

wherein R is a hydrocarbon group, $R^1$, and $R^2$ are hydrogen or hydrocarbon groups and $R^I$ and $R^{II}$ are substituted or unsubstituted arylene groups.

11 Claims, No Drawings

N,N'-DIALKYL-N,N'-DIPHENYL ALKYLENE DIAMINE DERIVATIVES AS ANTIKNOCK AGENTS

BACKGROUND

Aniline and certain alkyl derivatives thereof are known antiknock agents. However, aniline derivatives which are also tertiary amines—i.e., those containing no N—H bonds—are poor antiknock agents. U.S. Pat. Nos. 3,523,769 and 3,706,541 whose disclosures are incorporated herein by reference deal with the use of aniline and aniline-based diamines as antiknock agents.

THE INVENTION

It has been discovered that N-substituted bis-anilines containing few, if any N—H groups are effective antiknock additives for fuel compositions.

OBJECTS OF THE INVENTION

It is an object of the invention to produce useful antiknock agents.

It is another object of the invention to improve the combustion properties of fuels via the use of certain additives.

The Additives

The antiknock agents employed in the invention conform to the formula

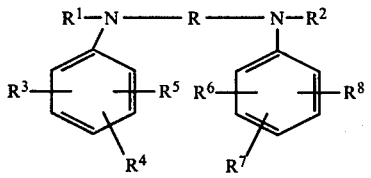

wherein R is a methylene or methyl methylene link, $R^1$ and $R^2$ are independently hydrogen or hydrocarbon-based groups, and $R^3$, and $R^4$, and $R^5$ are independently hydrogen, or hydrocarbon-based groups.

R is a hydrocarbyl linkage containing at least one carbon atom. Preferably, R contains 1 or 2 carbon atoms, such as $—CH_2—$, and $—CH(CH_3)$. Most preferably, R is a methylene link.

$R^1$ and $R^2$ can be the same or different. Each can be hydrogen. Each can contain from 1 to 12 carbon atoms. Suitable $R^1$ and $R^2$ groups include methyl, ethyl, isopropyl, benzyl and cyclohexyl groups. Preferably, $R^1$ and $R^2$ are hydrocarbon groups containing from 1 to 7 carbon atoms. Most preferably, they are both methyl groups.

$R^3$, $R^4$, $R^5$, $R^6$, $R^7$, and $R^8$ can be the same or different. Each contains from 0 to 20 carbon atoms. Generally these substituents are selected from hydrogen and hydrocarbon groups, e.g., methyl, ethyl, n-butyl, phenyl, methylphenyl, t-butyl, and isopropyl. They may be aliphatic, branched, cyclic, saturated or unsaturated. Preferably $R^3$, $R^4$, $R^5$, $R^6$, $R^7$, and $R^8$ are alkyl groups containing one to seven carbon atoms. Most preferably, one or more are methyl groups. Compounds in which one or two methyl groups are para to the N atoms are highly preferred.

The identity of each of the monovalent substituents—i.e. $R^1$ through $R^8$—depends upon the method of preparation of the compound and the starting materials employed. In one preferred embodiment, N-methyl aniline is reacted with formaldehyde to produce bis(N-methyl anilino) methane, also called N,N'-dimethyl,-N,N'-diphenyl methylene diamine. One or more other aldehydes, such as acetaldehyde can be employed as reactants. Acetaldehyde reacts with N-methyl aniline to form N,N'-dimethyl-N,N'-diphenyl ethylidene diamine, or with N-methyl-p-toluidine to form N,N'-dimethyl-N,N'-(4,4'-dimethyl)diphenyl ethylidene diamine.

The method used to produce the antiknock agents of the invention is not critical. It is believed that the tertiary amines used in the invention can be acquired by reacting suitable phenols and amines; by isolating by-products from colorant manufacturing processes; and by hydrotreating lignite coal, coal tars, shale oil, or tar sands.

Fuel Compositions

The inventive antiknock agents are admixed with one or more fuel components. Suitable fuel components with which the inventive agents can be mixed include gasoline, benzene, fuel oil, and kerosene. One or more additives are used in amounts which improve the combustion properties of the fuels to which they are added. Generally, a small but effective amount, sufficient to impart reduced knocking tendencies will be added. The quantity of antiknock agent employed will be between 0.1 and 15 weight percent, based on the weight of the fuel component(s). Preferred quantities lie between about 0.5 and 5 wt. %.

Additional ingredients, such as detergents, flow modifiers, corrosion inhibitors, emulsifiers, and gum inhibitors, can be employed along with the additive of the invention in fuel compositions.

EXAMPLES

The antiknock and octane-boosting properties of the additives of this invention are demonstrated by the following examples.

This example describes the evaluation of the inventive and comparative reference compounds as antiknock additives for unleaded gasoline. Antiknock activity is defined as the increase in Research Octant Number (RON) of a 0.1 molar solution of the compound to be tested in gasoline compared to the same gasoline without the additive. The RON values reported herein were determined according to a modified procedure outlined by the American Society of Testing and Materials titled "Standard Method of Test for Knock Characteristics of Motor Fuels by the Research Method". This method is designated as ASTM D2699-75. The modification used here was to compare the maximum knock air/fuel ratio of gasoline having the additive with 2 reference fuels having RON about 2 units less and greater than the test composition, then making a straight line extrapolation to determine the RON of the test composition. The unleaded gasoline used for this test is FT175, an unleaded fuel (Kansas City Premium Pipeline Base gasoline from Phillips Petroleum Co). Its characteristics are listed in Table I.

TABLE I

| Characteristics of Test Gasoline | |
|---|---|
| Designation | FT 175 |
| Reid Vapor Pressure, psi | 7.2 |
| API Gravity at 60° F. (15.6° C.) | 64.4 |
| ASTM Distillation<br>Vol. % Evaporated | Temp. °F. |

TABLE I-continued

| Characteristics of Test Gasoline | |
|---|---|
| IBP | 86 |
| 5 | 115 |
| 10 | 132 |
| 15 | 145 |
| 20 | 157 |
| 30 | 178 |
| 40 | 197 |
| 50 | 213 |
| 60 | 229 |
| 70 | 250 |
| 80 | 286 |
| 90 | 351 |
| 95 | 391 |
| EP | 428 |
| Lead Content g/gal. | 0.005 |
| Sulfur Content, wt. % | 0.04 |
| Research Octane Number (RON) | 91.5 |
| Motor Octane Number | 83.9 |
| **Component** | **Vol. %** |
| Paraffins | 69.01 |
| Olefins | 15.01 |
| Naphthenes | 6.63 |
| Aromatics | 9.33 |
| Average Molecular Weight | 101.3 |
| Atomic Ratio Hydrogen/Carbon | 2.10 |
| Stoichiometric Air-Fuel Ratio | 14.89 |

In Table II are listed the results of antiknock tests employing two inventive additives and a comparative additive. The designation ΔRON is the difference of the base gasoline and the RON of the source base gasoline with the antiknock additive. Methyl-t-butyl ether (MTBE) is commercially available and well known as an octane improver.

TABLE II

Antiknock Character of Additives with FT-175 Gasoline

| Additive[1] | RON | Δ RON |
|---|---|---|
| none[2] | 91.7 | — |
| N,N'—dimethyl-N,N'—diphenylmethylene diamine | 94.0 | 2.3 |
| N,N'—dimethyl-N,N'—(4,4'dimethyl)-diphenylmethylenediamine | 95.1 | 3.4 |
| Methyl-t-butylether | 91.9 | 0.2 |

[1]0.1 molar concentration
[2]FT-175 described above and in Table 1

The examples recited above demonstrate the effectiveness of the inventive anti-knock agents as octane improvers. In the tests given above, they outperformed MTBE in improving the combustion properties of the test gasoline.

We claim:

1. A fuel composition having antiknock characteristics containing at least one compound of the formula:

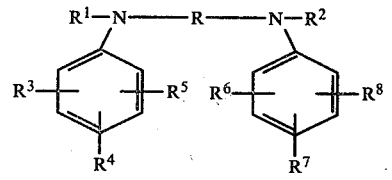

wherein R is hydrocarbyl; $R^1$ and $R^2$ are independently selected from alkyl groups having from 1 to about 7 carbon atoms; and $R^3$, $R^4$, $R^5$, $R^6$, $R^7$ and $R^8$ are independently hydrogen or hydrocarbon groups.

2. The fuel composition of either of claims 1 or 2 wherein $R^3$, $R^4$, $R^5$, $R^6$, $R^7$ and $R^8$ are independently selected from the group consisting of hydrogen, $C_{1-7}$ alkyl groups, and aryl groups.

3. The fuel composition of either of claims 1 or 2 wherein one or two methyl groups are para to the nitrogen atoms.

4. The fuel composition of either of claim 1 wherein R is methylene, and $R^1$ and $R^2$ are both methyl groups.

5. A method of improving the antiknock performance of a fuel composition comprising adding to the composition at least one compound of the formula:

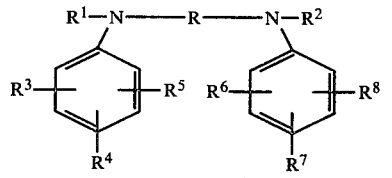

wherein R is hydrocarbyl; $R^1$ and $R^2$ are independently selected from alkyl groups having from 1 to about 7 carbon atoms and $R^3$, $R^4$, $R^5$, $R^6$, $R^7$, and $R^8$ are independently hydrogen or hydrocarbon groups.

6. The method of claim 5 wherein $R^1$ and $R^2$ are independently selected from the group consisting of alkyl groups having from 1 to about 7 carbon atoms.

7. The method of either of claims 6 or 7 wherein $R^3$, $R^4$, $R^5$, $R^6$, $R^7$ and $R^8$ are independently selected from the group consisting of hydrogen, $C_{1-7}$ alkyl groups, and aryl groups.

8. The method of either of claims 6 or 7 wherein one or two methyl groups are para to the nitrogen atoms.

9. The method of any one of claims 6 or 7 wherein R is methylene, and $R^1$ and $R^2$ are both methyl groups.

10. The method of claim 8 wherein R is methylene and $R^1$ and $R^2$ are both methyl groups.

11. The fuel composition of claim 3 wherein R is methylene and $R^1$ and $R^2$ are both methyl groups.

* * * * *

UNITED STATES PATENT AND TRADEMARK OFFICE

CERTIFICATE OF CORRECTION

PATENT NO. : 4,417,904

DATED : November 29, 1983

INVENTOR(S) : Lyle D. Burns; Robert M. Parlman

It is certified that error appears in the above-identified patent and that said Letters Patent is hereby corrected as shown below:

Claim 7, line 1, "claims 6 or 7" should read --claims 5 or 6--.

Signed and Sealed this

*Fifth* Day of *June 1984*

[SEAL]

*Attest:*

GERALD J. MOSSINGHOFF

*Attesting Officer*

*Commissioner of Patents and Trademarks*